US006347798B1

(12) United States Patent
Quiring et al.

(10) Patent No.: US 6,347,798 B1
(45) **Date of Patent: *Feb. 19, 2002**

(54) AUTOMATIC RESET TARGET

(76) Inventors: Gary H. Quiring; Brent G. Quiring, both of P.O. Box 197A, Windom, MN (US) 56101

( * ) Notice: Subject to any disclaimer, the term of this patent is extended or adjusted under 35 U.S.C. 154(b) by 0 days.

This patent is subject to a terminal disclaimer.

(21) Appl. No.: 09/491,565

(22) Filed: Jan. 26, 2000

Related U.S. Application Data

(63) Continuation of application No. 29/107,862, filed on Jul. 16, 1999, now Pat. No. Des. 425,135.

(51) Int. Cl.[7] ..... F41J 7/04
(52) U.S. Cl. ..... 273/391
(58) Field of Search ..... 273/391, 392, 273/407, 406

(56) References Cited

U.S. PATENT DOCUMENTS

| | | | | |
|---|---|---|---|---|
| 996,712 | A | | 7/1911 | Harper |
| 1,098,255 | A | | 5/1914 | Harper |
| 3,411,784 | A | | 11/1968 | Lawrence |
| D235,155 | S | | 5/1975 | Perkins |
| 4,116,443 | A | | 9/1978 | Dorfman |
| 4,550,918 | A | * | 11/1985 | Motsenbocker ..... 273/391 |
| 4,588,194 | A | | 5/1986 | Steidle et al. |
| 4,726,593 | A | | 2/1988 | Wade |
| 4,949,980 | A | | 8/1990 | Hoy |
| 5,181,721 | A | | 1/1993 | Halliburton |
| 5,263,722 | A | | 11/1993 | Rosellen |
| 5,324,043 | A | | 6/1994 | Estrella |
| 5,533,732 | A | | 7/1996 | Leinen, Sr. et al. |
| D392,687 | S | | 3/1998 | Wilson, Sr. |
| D405,834 | S | | 2/1999 | Weng et al. |

FOREIGN PATENT DOCUMENTS

| | | | | |
|---|---|---|---|---|
| DE | 3534746 | * | 4/1987 | ..... 273/391 |
| FR | 471312 | * | 7/1914 | ..... 273/391 |

* cited by examiner

*Primary Examiner*—Mark S. Graham

(57) ABSTRACT

An automatic reset target has an upright frame connected to a stand for supporting the target on a surface. A plurality of target arms having target pads that swing on a rod secured to the frame between down target positions to neutral out-of-sight non-target positions when the target pads are hit with projectiles. A trigger arm pivotally mounted on the frame has a target arm holding member which retains the target arms and pads in the neutral out-of-sight non-target positions. A trigger arm pad on the upper end of the trigger arm when hit with a projectile swings the trigger arm in a direction to move the target arm holding member out of engagement with target arms and pads to allow the target arms and pads to return to their down target positions.

25 Claims, 4 Drawing Sheets

AUTOMATIC RESET TARGET

CROSS REFERENCE TO RELATED APPLICATION

This application is a continuation of: U.S. application Ser. No. 29/107,862 filed Jul. 16, 1999 , now U.S. Pat. No. Des. 425,135.

FIELD OF THE INVENTION

The invention relates to a firearm target apparatus having a plurality of targets movable upon impact with bullets from target positions to non-target positions. The target apparatus has structures operative to allow the targets to return to their target positions.

BACKGROUND OF THE INVENTION

Target shooting with rifles, pistols and firearms is a common sport, hobby and pastime. Permanent and portable target structures having targets with identifiable areas, such as bullseye designs, of desired bullet impact are used to determine the point of impact of the bullet and accuracy of the aim of the shooter. Upon impact with a bullet the target is either changed or moved to a non-target position. The target must be reset or returned to the target position before shooting can continue. It is convenient to a have portable and automatically resettable target apparatus for all levels of shooters. Examples of automatically resettable targets are disclosed by C. W. Harper in U.S. Pat. Nos. 996,712 and 1,098,255; J. R. Lawrence in U.S. Pat. No. 3,411,784; and W. E. Rosellen in U.S. Pat. No. 5,263,722.

SUMMARY OF THE INVENTION

The invention is a firearm target apparatus having a plurality of target pendulums that when hit by a bullet or projectile swing to neutral out-of-sight non-target positions are retained in the non-target positions with a trigger assembly. The target pendulums are allowed to reset or return to the target positions when the trigger assembly is hit by a projectile which moves the trigger assembly to release the target pendulums and allow the target pendulums to swing to their target positions.

The automatic reset target apparatus has a stand for supporting the target apparatus on a surface, such as the ground or shooting stand. A frame connected to the stand extends upwardly and supports a transverse rod and a trigger. A plurality of target pendulums having arms pivotally mounted on the rods and target pads secured to the lower ends of the arms are spaced along the transverse length of the rod. The trigger has an arm pivotally mounted on the upper end of the frame above the rod, a trigger target pad connected to the upper end of the arm, and a transverse member on the lower end thereof for retaining the target pendulums in their non target positions. The rod mounted on the frame is parallel with the transverse member of the trigger. The target pads when hit with projectiles swing the target arms and pads connected thereto backward from the down target positions to neutral out-of-sight non-target positions with the arms or pads resting on the transverse member of the trigger. To reset the target pendulums to target positions, the trigger target pad is hit with a projectile from the shooter's firearm. The impact of the projectile pivots the trigger and moves the transverse member out of engagement with the target arms and pads. All of the target arms and pads freely swing to their down target positions. The target apparatus is reset for a second round of shooting.

DESCRIPTION OF THE INVENTION

Figure 1:
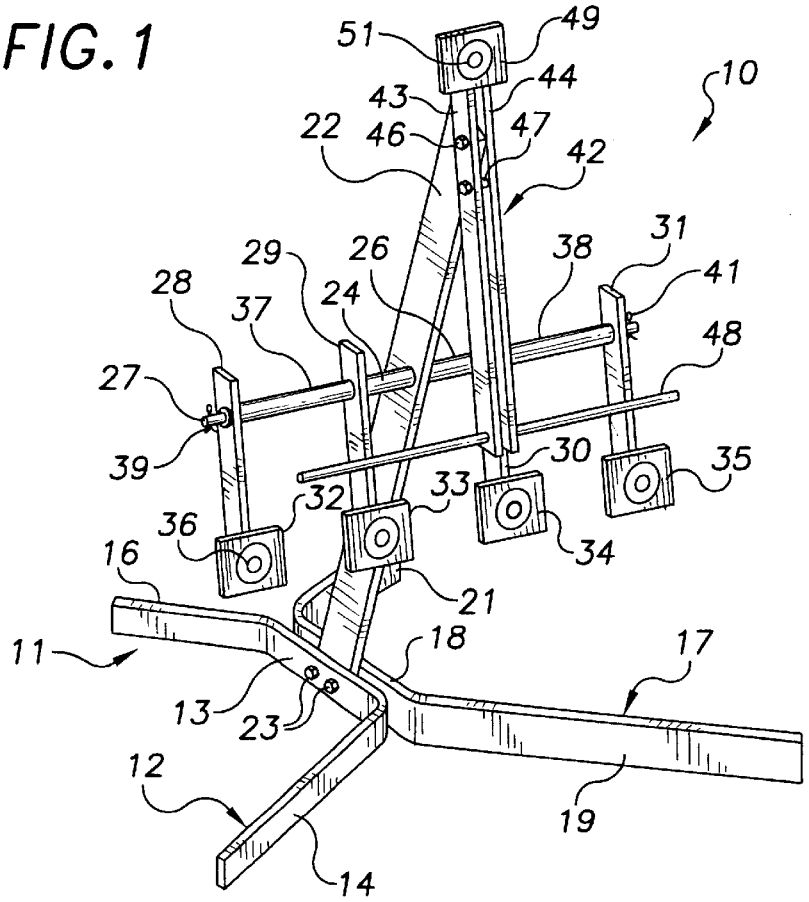
FIG. 1 is a perspective view of the automatic reset target apparatus of the invention.

An automatic reset target, indicated generally at 10 in FIGS. 1 to 7, is an apparatus for individual and group firearm shooting for all levels of shooters. Firearms using .22 caliber long and long rifle cartridges can be used with firearms by shooters to fire bullets or projectiles at the target. The target is a portable unit that can be transported to a shooting location and used without assembly of and adjustment of parts.

Automatic reset target apparatus 10 has a stand assembly 11 for supporting the apparatus on a surface such as the ground or platform. Stand assembly 11 has a first stand member 12 and a second stand member 17 connected to an upright frame 22 with bolts 23. Stand member 12 is a U-shaped metal member having a base 13 and a front leg 14 and a rear leg 16 joined to opposite ends of the base. Front leg 14 is longer than rear leg 16 and extends in an outward and forward direction. Rear leg 16 extends outward and rearward from base 13. Stand member 17 has the same shape as stand member 12 with a base 18 joined to front and rear legs 19 and 21. The legs of the stand assembly 11 laterally and longitudinally support target apparatus 10 on a surface. Bolts 23 clamp bases 13 and 18 against opposite sides of the lower end of frame 22.

Figure 2:
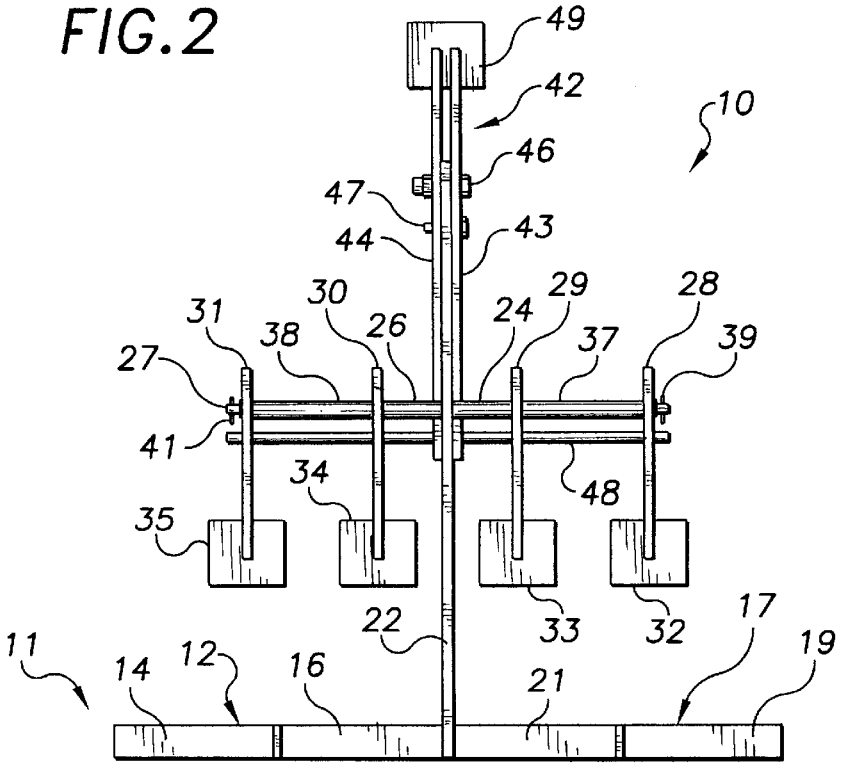
FIG. 2 is a rear elevational view of FIG. 1.
Figure 3:
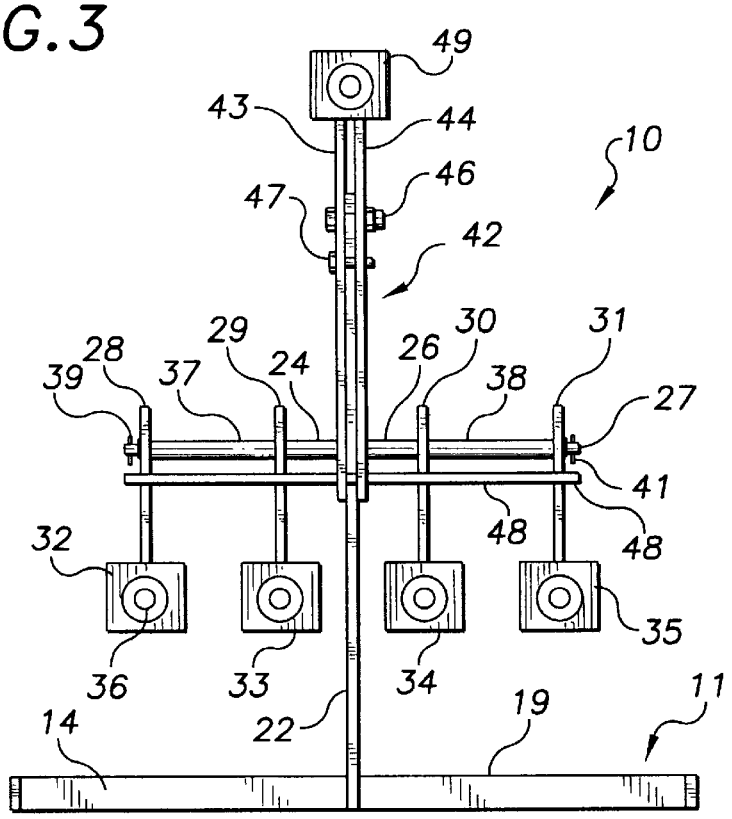
FIG. 3 is a front elevational view of FIG. 1.
Figure 4:
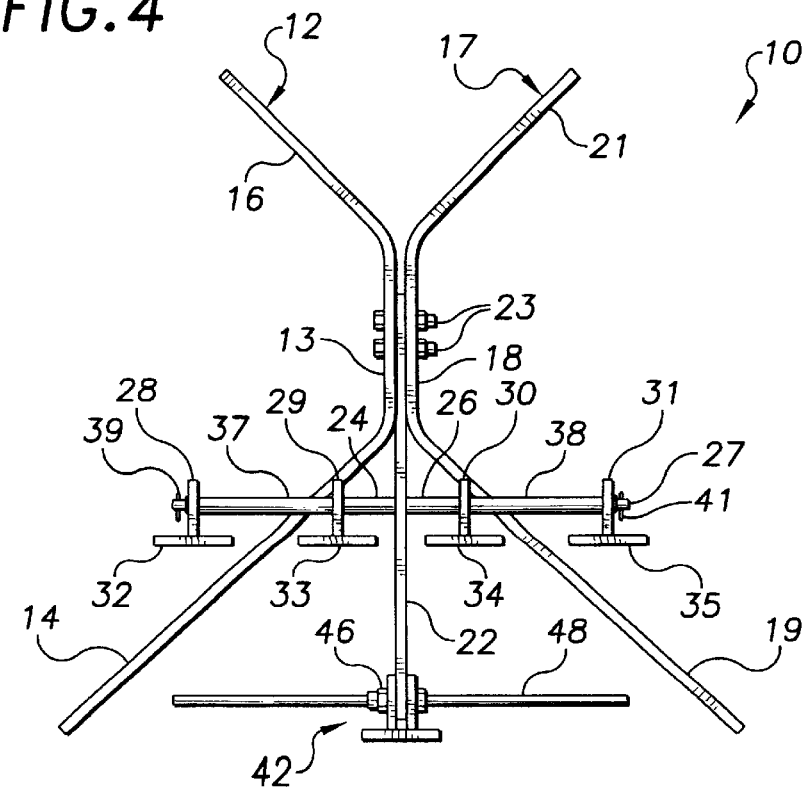
FIG. 4 is a top plan view of FIG. 1.
Figure 5:
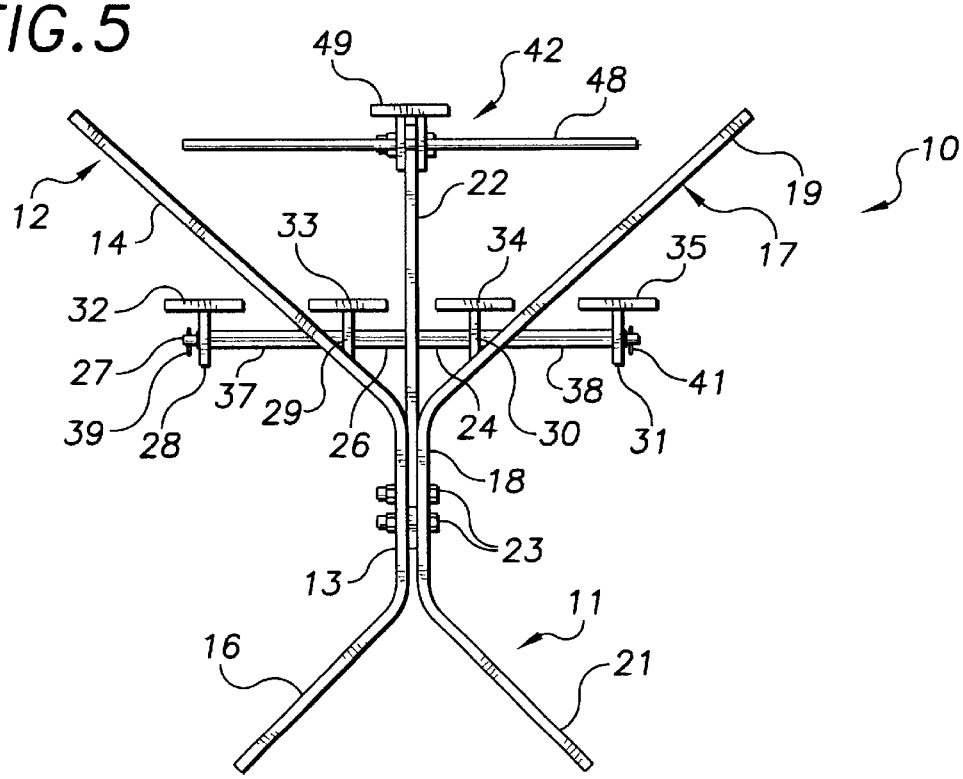
FIG. 5 is a bottom plan view of FIG. 1.

Frame 22 is a flat linear bar extended upwardly and forward at an angle of 50 degrees relative to the horizontal plane of stand assembly 11. Other angles of frame 22 relative to stand assembly 11 can be used to support frame 22 in its upright position. As seen in FIGS. 1 to 4, lateral sleeves or tubular members 24 and 26 are secured to opposite sides of the middle section of frame 22. Sleeves 24 and 26 have cylindrical passages axially aligned with a hole in frame 22. A transverse rod 27 extended through sleeves 24 and 26 rotatably supports target pendulums having arms 28, 29, 30 and 31. Arms 28–31 are flat bar pendulums having upper ends with holes accommodating rod 27. Target pads 32, 33, 34 and 35 are attached to lower ends of arms 28–31. The target pads 32–35 are flat square steel plates having flat front faces. Target painting indicia or circular designs 36 are attached to the front faces of the target pads 32–35. Other types of target designs can be located on the front faces. Tubular spacers or sleeves 37 and 38 located around rod 27 laterally space arms 28 and 29 and arms 30 and 31. Sleeves 24 and 26 laterally space arms 29 and 30. As seen in FIGS. 2 and 3, adjacent arms are equally spaced from each other. Fasteners 39 and 41, as cotter pins, on opposite ends of rod 27 retain arms 28–31 and sleeves 37 and 38 in assembled relationship on rod 27.

Figure 6:
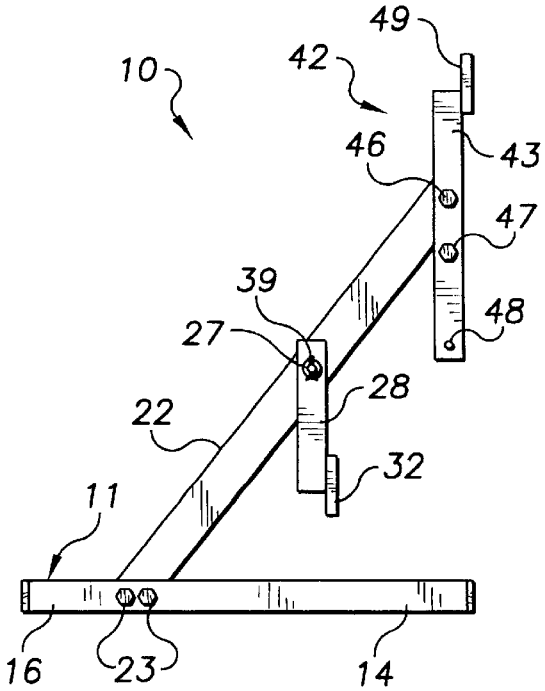
FIG. 6 is a side elevational view of the left side of FIG. 1.
Figure 7:
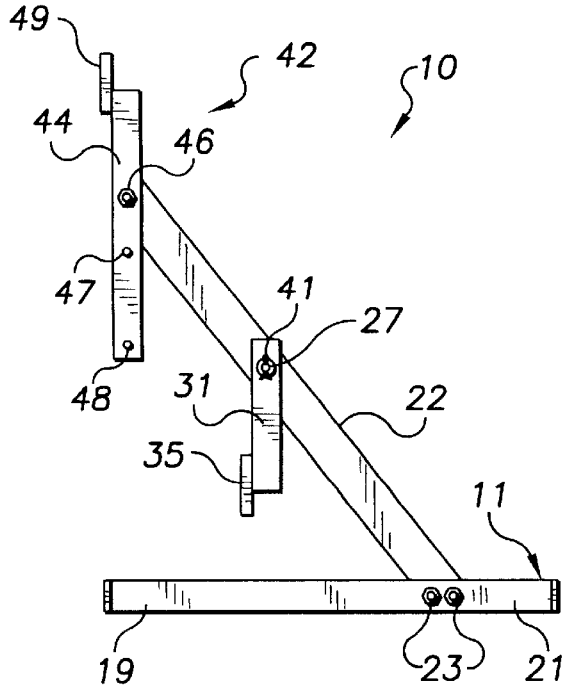
FIG. 7 is a side elevational view of the right side of FIG. 1.
Figure 8:
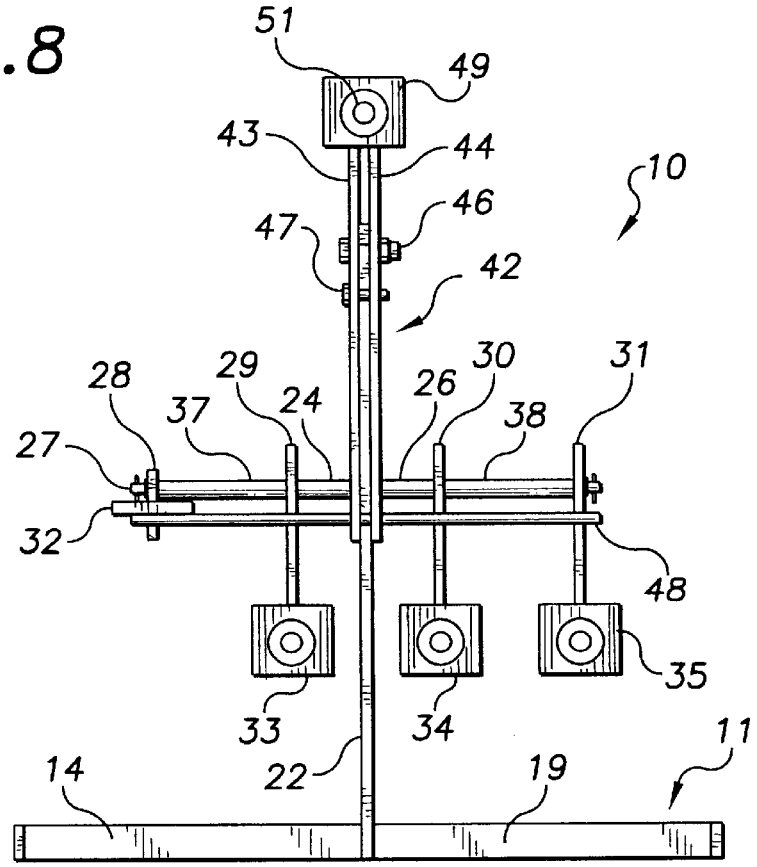
FIG. 8 is a front elevational view of the automatic reset target apparatus with one target pad in the target pad neutral position.
Figure 9:
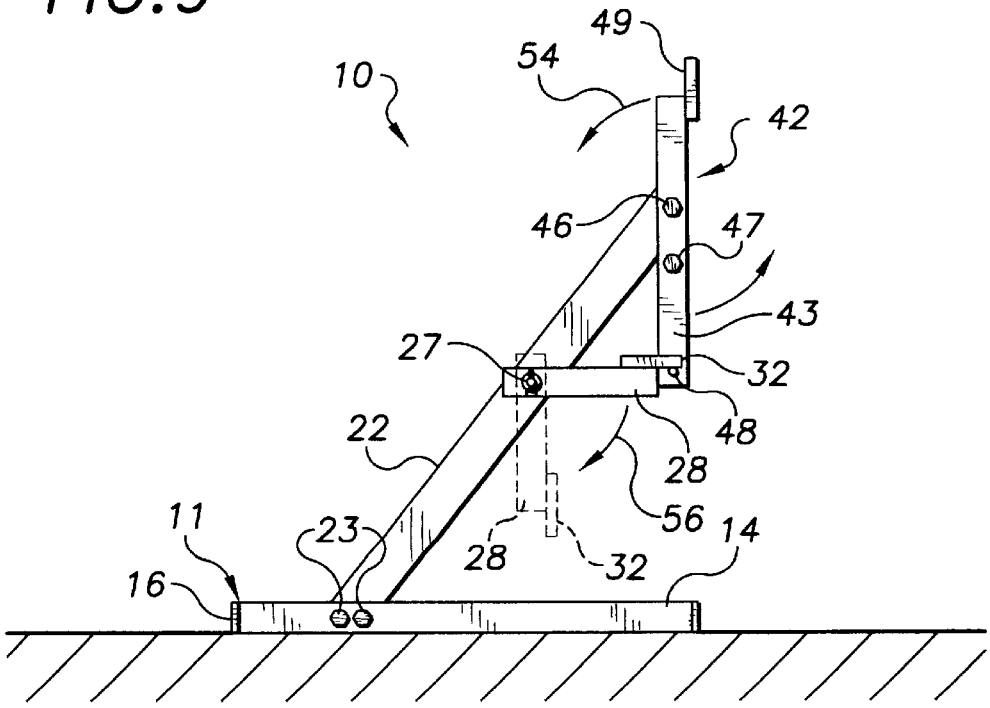
FIG. 9 is a side elevational view of the automatic reset target apparatus with the target pads in the target pad neutral positions.

A trigger 42 pivotally mounted on the upper end of frame 22 retains the target arms 28–31 and pads 32–35 in neutral out-of-sight non-target positions. When trigger 42 is hit with a projectile it moves to a position that releases the target arms 28–31 and pads 32–35 to allow the target arms 28–31 to swing down to target positions. Trigger 42 is a generally upright arm having linear flat members or bars 43 and 44. Upper middle sections of bars 43 and 44 are located adjacent the upper end of frame 22. A transverse pivot member 46, such as a bolt, pivotally connects bars 43 and 44 to the upper end of frame 22. A stop pin 47 mounted on bars 43 and 44 below pivot member 46 extends between bars 43 and 44 and engages frame 22 to locate trigger 42 in its upright position, as shown in FIGS. 6 and 7. The upper ends of bars 43 and 44 extended upwardly from pivot member 46 are attached to a trigger target pad 49. Pad 49 is a flat square steel plate having a flat front face. A target design 51 located on the front face provides the shooter with a target to reset the target arms 28–31 and pads 32–35 to their down target positions. The lower sections of bars 43 and 44 are longer than the upper ends of bars 43 and 44 so that the weight of the lower section of bars 43 and a transverse member or trigger rod 48 maintains trigger 42 in the upright position. Transverse rod 48 secured to the lower ends of bars 43 and 44 extends laterally in opposite directions. Rod 48 is parallel to target arms and support rod 27. When trigger 42 is in the upright position the distance between rods 27 and 48 is less than the lengths of the target arms 28–31 and pads 32–35 attached thereto. As shown in FIG. 9, when the target arm 28 is in the neutral out-of-sight position, shown in full lines, pad 32 rests on rod 48 to hold the arm 28 and 32 in the neutral position. The outer ends of target arms 28–31 can be supported on trigger arm 48.

In use, target apparatus 10 is placed in a field or shooting range at a selected distance from the shooting position. A distance of 25 yards is a minimum distance for small firearms target practice. The shooter in either prone, sitting or standing positions aims and discharges a firearm which directs a bullet or projectile toward a target pad 32. The force of the projectile hitting the target pad 32 causes the target pad and arm to swing backward about 270 degrees or until target pad 32 rests on trigger rod 48. The shooter consecutively aims and discharges the firearm to hit target pads 33, 34 and 35 causing these target pads and arms attached thereto to swing backward until all the target pads 32 rest on trigger rod 48.

Referring to FIG. 9, the shooter automatically resets the target arms 28–31 and target pads 32–35 to the target positions by discharging the firearm which directs a projectile 52 in the path of arrow 53. The projectile 52 hits trigger pad 49 causing the trigger to swing about pivot member 46 in the direction of arrow 54, shown as counter-clockwise. The trigger rod 48 swings forward and away from target pads 32–35. When trigger rod 48 disengages target pads 32–35, the target arms 28–31 and target pads 32–35 attached thereto are free to swing to the down target position. The target apparatus 10 is reset for a second round of shooting.

The invention has been illustrated and described as a multiple automatic reset target apparatus. Changes in structure, materials, and arrangements of structures can be made by one skilled in the art without departing from the invention.

What is claimed is:

1. An automatic reset target apparatus comprising: a stand assembly comprising first and second stand brackets, each bracket having a base, an outwardly and rearwardly directed rear leg and an outwardly and forwardly distal front leg, an upwardly directed frame having an upper end and a lower end, fastener means connecting the lower end of the frame to the base of each stand bracket whereby when the stand assembly is located on a generally horizontal support the frame extends in an upward and forward direction, tubular members secured to the frame, said tubular members extended transversely from opposite sides of the frame, a transverse first rod mounted on the tubular members, a plurality of target arms pivotally mounted on the first rod for movement between down target positions and neutral out-of-sight non-target positions, said arms having lower end portions spaced from the rod, spacer means on the first rod between adjacent arms to laterally space adjacent arms along the length of the first rod, target pads secured to the lower end portions of the arms, said target pads having front faces, target indicia located on said front faces, a trigger arm having an upper end located above the frame and a lower end extended downwardly, pivot means connecting the trigger arm to the upper end of the frame, stop means on the trigger arm below the pivot means engageable with the frame to retain the trigger arm in an upright position and allow the trigger arm to swing to a target arm release position, a transverse second rod secured to the lower end of the trigger arm for holding the target arms and pads in the neutral out-of-sight non-target position when the trigger arm is in the upright position, said target pads when hit with projectiles swing with the target arms from the down target positions to the neutral out-of-sight non-target positions in engagement with second rod, and a trigger target pad connected to the upper end of the trigger arm, said trigger target pad having a front face, target indicia located on the front face of the trigger pad, said trigger target pad when hit with a projectile pivots the trigger arm rearwardly and moves the second rod to the target arm release position out of engagement with the target arms and target pads whereby the target arms and target pads swing downwardly to the target positions and said trigger arm returns to the upright position.

2. The apparatus of claim 1 wherein: the front leg of each stand bracket is longer than the rear leg thereof.

3. The apparatus of claim 1 wherein: the frame is a flat bar having a lower end connected to the base of each stand bracket with said fastener means.

4. The apparatus of claim 1 wherein: the target arms are flat bars having upper ends pivotally mounted on the first rod to swing between said down target positions and neutral out-of-sight non-target positions.

5. The apparatus of claim 4 wherein: the spacer means are tubular sleeves surrounding the first rod between adjacent arms.

6. The apparatus of claim 1 wherein: the target pads are generally square flat plates secured to the end portions of the target arms.

7. The apparatus of claim 1 wherein: the trigger arm comprises a pair of flat linear bars located adjacent opposite sides of the upper end of the frame, said second rod being connected to lower end portions of the bars.

8. The apparatus of claim 7 wherein: the stop means comprise a member extended between the bars and engageable with the frame to locate the trigger arm in the upright position.

9. An automatic reset target apparatus comprising: stand means for supporting the target apparatus on a surface, a frame having a bar extended upwardly from the stand means, means connecting the bar to the stand means, a horizontal first rod mounted on the bar above the stand means, at least one target arm pivotally mounted on the first rod for pivotal movement between a down target position and a neutral out-of-sight non-target position, said target arm including a target portion, a trigger arm having a lower end and an upper end, a horizontal second rod located generally parallel to the first rod secured to the lower end of the trigger arm in the neutral out-of-sight non-target position, and pivot means pivotally connecting the trigger arm to the bar above the transverse second rod, said trigger arm having a trigger target portion located above the pivot means, said target portion when hit with a projectile swings with the target arm from the down target position to the neutral out-of-sight non-target position in engagement with the second rod, said trigger target portion when hit with a projectile swings the trigger arm to move the second rod out of engagement with the target arm whereby the target arm moves downwardly to the target position.

10. The apparatus of claim 9 including: a plurality of target arms having target portions pivotally mounted on the first rod for movement between down target positions and neutral out-of-sight non-target positions.

11. The apparatus of claim 10 including: spacer means mounted on the first rod between adjacent target arms for laterally separating adjacent target arms.

12. An automatic reset target apparatus comprising: stand means for supporting the target apparatus on a surface, a frame extended upwardly from the stand means, said frame is a flat frame bar extended in an upward direction from the stand means, said bar having a lower end and an upper end, means connecting the lower end of the frame to the stand means, a transverse rod mounted on the frame above the stand means, at least one target arm pivotally mounted on the rod for movement between a down target position and a neutral out-of-sight non-target position, a target pad secured to the target arm, a trigger arm having a member for retaining the target arm and pad in the neutral out-of-sight non-target position, pivot means pivotally connecting the trigger arm to the upper end of the bar of the frame above the transverse rod, and a trigger target pad secured to the trigger arm above the pivot means, said target pad when hit with a projectile swings with the target arm from the down target position to the neutral out-of-sight non-target position in engagement with said member, said trigger target pad when hit with a projectile swings the trigger arm to move the member out of engagement with the target arm and pad whereby the target arm and target pad moves downwardly to the target position.

13. The apparatus of claim 12 wherein: the trigger arm has a pair of linear members located adjacent opposite sides of the upper end of frame bar, and stop means located between the pair of members engageable with the frame bar to locate the trigger arm in an upright position.

14. An automatic reset target apparatus comprising: stand means for supporting the target apparatus on a surface, a frame having a lower end and an upper end, means connecting the lower end of the frame to the stand means, a transverse first rod, means mounting the transverse rod on the frame between the upper and lower ends of the frame, a plurality of pendulum targets pivotally mounted on the first rod, each pendulum target having an arm and a target pad secured to the arm, said arm and pad being moveable between a down position and a neutral out-of-sight non-target position, a trigger operative for retaining the arm and pad in the neutral out-of-sight non-target position, said trigger having a trigger arm having an upper end and a lower end, a transverse second rod mounted on the lower end of the trigger arm parallel to the first rod, and a trigger target pad on the upper end of the trigger arm, and pivot means pivotally connecting the trigger arm to the upper end of the frame, said target pads when hit with projectiles swing with the target arms from the down target positions to the neutral non-target positions locating the targets in engagement with the second rod, and said trigger target pad when hit with a projectile swings the trigger arm to move the second rod out of engagement with the targets whereby the target arms and pads swing downwardly to the target positions.

15. The apparatus of claim 14 including: spacer means mounted on the first rod between adjacent target arms for laterally separating adjacent target arms and pads.

16. The apparatus of claim 14 wherein: the frame is a flat linear bar having an upper end.

17. The apparatus of claim 16 wherein: the means mounting the transverse first rod on the frame comprises sleeves secured to opposite sides of the bar.

18. The apparatus of claim 16 wherein: the pivot means pivotally connecting the trigger arm to the frame comprises a transverse pivot member located below the trigger target pad mounted on the upper end of the bar.

19. The apparatus of claim 16 wherein: the trigger arm has a pair of linear members located adjacent opposite sides of the upper end of the bar, said pivot means pivotally connecting the members to the upper end of the bar.

20. The apparatus of claim 14 including: stop means on the trigger arm engageable with the frame to maintain the trigger arm in an upright position.

21. A target apparatus comprising: a stand for supporting the target apparatus on a surface, a frame extended upwardly from the stand, said frame having a lower end and an upper end, a connector attaching the lower end of the frame to the stand, a transverse horizontal first rod mounted on the frame between the upper and lower ends of the frame, a plurality of pendulum targets pivotally mounted on the first rod for swinging movement about the axis of the first rod between a down position and a generally horizontal position, sleeves mounted on the first rod between adjacent targets to laterally space adjacent targets, each target having an arm having an upper end and a lower end and a target portion at the lower end of the arm, said upper end of the arm being pivotally mounted on the first rod, a trigger for retaining the targets in the generally horizontal positions, said trigger having an upright trigger arm having an upper end and lower end, a transverse second rod connected to the lower end of the trigger arm, said second rod being generally parallel with the first rod and located forwardly of the first rod, a trigger target position at the upper end of the trigger arm, a pivot pivotally connecting the trigger arm below the trigger target position to the upper end of the frame for swinging movement about a generally horizontal axis, said target portions of the pendulum targets when hit with moving projectiles swing with the target arms from the down positions to the generally horizontal positions locating the targets in engagement with the second rod whereby the second rod holds the targets in the generally horizontal positions, said trigger target portion when hit with a moving projectile swings the lower end of the trigger arm and second rod in a forward direction whereby the second rod moves out of engagement with the targets to allow the targets to swing from the generally horizontal positions to the downward positions.

22. The apparatus of claim 21 wherein: the stand includes forwardly diverging legs for supporting the target apparatus on a surface.

23. The apparatus of claim 21 wherein: the frame extends in an upwardly and forwardly direction relative to the stand.

24. The apparatus of claim 21 wherein: the first rod has a middle portion mounted on the frame and the second rod has a middle portion connected to the lower end of the trigger arm.

25. The apparatus of claim 21 wherein: four pendulum targets are pivotally mounted.

* * * * *